US007207667B2

(12) United States Patent
Ansier et al.

(10) Patent No.: US 7,207,667 B2
(45) Date of Patent: Apr. 24, 2007

(54) APPARATUS AND METHOD FOR REFURBISHING USED CARTRIDGES FOR INK JET TYPE IMAGING DEVICES

(75) Inventors: Mark J. Ansier, Austin, TX (US); Frank Jemela, Katy, TX (US)

(73) Assignee: Tonerhead, Inc., McHenry, IL (US)

( * ) Notice: Subject to any disclaimer, the term of this patent is extended or adjusted under 35 U.S.C. 154(b) by 288 days.

(21) Appl. No.: 10/876,226

(22) Filed: Jun. 24, 2004

(65) Prior Publication Data

US 2004/0263589 A1 Dec. 30, 2004

Related U.S. Application Data

(60) Provisional application No. 60/482,052, filed on Jun. 24, 2003.

(51) Int. Cl.
*B41J 2/175* (2006.01)
*B41J 2/165* (2006.01)
*B65B 1/043* (2006.01)

(52) U.S. Cl. ..... 347/85; 347/22; 141/18

(58) Field of Classification Search ..... 347/7, 347/22, 85; 141/2, 8, 9, 18, 94, 100, 104
See application file for complete search history.

(56) References Cited

U.S. PATENT DOCUMENTS

| | | | | |
|---|---|---|---|---|
| 6,729,360 | B2 * | 5/2004 | Sesek et al. | 141/2 |
| 6,820,972 | B2 * | 11/2004 | Kinalski | 347/85 |
| 6,920,903 | B2 * | 7/2005 | Ansier et al. | 141/2 |
| 2004/0032442 | A1 * | 2/2004 | Phillips | 347/19 |

* cited by examiner

*Primary Examiner*—Anh T. N. Vo

(74) *Attorney, Agent, or Firm*—Vedder Price Kaufman & Kammholz

(57) ABSTRACT

An apparatus for refurbishing used ink jet cartridges and a method for operating an ink jet cartridge refurbishment facility. The apparatus includes a number of stations and accessories that perform the recovery and filling aspects of the ink jet cartridge refurbishment process. This apparatus may be one of a number of machines used in an ink jet cartridge refurbishment facility where ink jet device users may drop-off their used ink jet cartridges and pick-up replacement ink jet cartridges at the same location that refurbished the ink jet cartridges.

12 Claims, 8 Drawing Sheets

APPARATUS AND METHOD FOR REFURBISHING USED CARTRIDGES FOR INK JET TYPE IMAGING DEVICES

CROSS-REFERENCE TO RELATED APPLICATION

This application is related to United States Provisional Patent Application Ser. No. 60/482,052 filed Jun. 24, 2003, and entitled, APPARATUS AND METHOD FOR REFURBISHING USED CARTRIDGES FOR INK JET TYPE IMAGING DEVICES. The Applicants claim the benefit of this prior provisional application under 35 U.S.C. §119(e). The entire contents of this provisional application is incorporated herein by this reference.

TECHNICAL FIELD OF THE INVENTION

The invention is directed to the refurbishment of ink jet cartridges used in ink jet type imaging devices such as printers, photocopiers, and facsimile machines, for example. The invention encompasses devices for refurbishing used ink jet cartridges and business methods for the convenient recycling of used ink jet cartridges.

BACKGROUND OF THE INVENTION

Ink jet imaging devices produce text and images on a substrate such as paper by ejecting minute quantities of ink from a reservoir onto the substrate in response to electrical commands. The electrical commands activate small orifices or ink jets in a print head to eject the ink in the desired locations to form the desired images. Because the ink in an ink jet imaging device is used up eventually in the printing process, conventional ink jet imaging devices include the ink reservoir in a replaceable cartridge commonly referred to as an ink jet cartridge. The print head containing the orifices through which the ink is ejected is also commonly included in the replaceable ink jet cartridge. The remainder of the ink jet imaging device includes electrical control components and mechanical components for moving the ink jet cartridge with respect to the printing substrate (paper) and for moving the substrate with respect to the ink jet cartridge.

Photocopiers, printers, plotters, and facsimile machines are examples of devices that may utilize an ink jet printing or imaging process. As used in this disclosure "ink jet device" encompasses any type of device using an ink jet process. Also, for purposes of the following description, the portion of the ink jet device other than the ink jet cartridge will be referred to herein simply as an ink jet device whether or not the ink jet cartridge is installed. The portion of the ink jet device that carries the consumable ink for the ink jet imaging process will be referred to as an "ink jet cartridge" or "cartridge" regardless of the particular design and regardless of the other components included on the device such as a print head and associated electrical lines and contacts.

FIG. 1 is a view in perspective of a typical prior art ink jet cartridge 100 with the bottom of cartridge 100 shown face up. Ink jet cartridge 100 includes a container 101 adapted to contain a supply of ink (the ink not being shown in the figure). The bulk of container 101 is generally rectangular in shape with a lower portion 102 projecting from the rest of the container. Print head assembly 104 is located on lower portion 102 of container 101 and includes a large number of minute, electrically stimulated orifices or ink jets 105 through which ink from container 101 is ejected in the printing process. It will be appreciated that the orifices or ink jets are shown diagrammatically in FIG. 1 in an exaggerated scale, and that the orifices are in fact very small in order to produce the desired image resolution. The commands or electrical stimuli required to operate the orifices or ink jets 105 are applied to print head assembly 104 through electrical conductors 106 which terminate at contact pads 107 on a side of container 101. An ink jet printing device in which cartridge 100 is to be used will include a corresponding set of electrical contacts exposed so as to make contact with contact pads 107 on the cartridge. The electrical signals required for operating print head assembly 104 originate from a print control system (not shown) included in the ink jet imaging device. The illustrated prior art ink jet cartridge 100 also includes additional orifices facilitating fluid communication to ink container 101. The first additional orifice comprises an opening 109 commonly referred to as a vent opening or vent hole. The second additional orifice comprises an opening which is commonly referred to as a maze opening or maze hole located on the surface of cartridge 100 indicated by arrow 112. The maze hole is associated with a ball that functions as a check valve to prevent the flow of material out of container 101.

Due to space limitations and other physical restrictions in ink jet devices, ink jet cartridges typically have a relatively limited supply of the ink for use in the ink jet printing process. The working life of the print head assembly of an ink jet cartridge is, in fact, commonly much greater than the working life of the ink supply in the cartridge. Thus, although original equipment manufacturers may prefer for ink jet device users to use totally new ink jet cartridges due to the relatively high profit margins associated with selling new ink jet cartridges, it is commonly possible to refurbish and reuse ink jet cartridges many times before they are no longer serviceable. Due to the popularity and low cost of ink jet devices, the sale of both new and used ink jet cartridges has become a very big business.

SUMMARY OF THE INVENTION

The present invention includes an apparatus for refurbishing used ink jet cartridges and a method for operating an ink jet cartridge refurbishment facility. The apparatus includes a number of stations and accessories that perform the recovery and filling aspects of the ink jet cartridge refurbishment process. This apparatus may be one of a number of machines used in an ink jet cartridge refurbishment facility where ink jet device users may drop-off their used ink jet cartridges and pick-up replacement ink jet cartridges at the same location.

A method embodying the principles of the invention includes directly receiving used ink jet cartridges from ink jet device users and returning replacement ink jet cartridges to the respective inkjet device users. As used in this disclosure, an "inkjet device user" or "user" includes anyone that owns or operates an ink jet device. Inkjet device users may deposit their used ink jet cartridges and retrieve replacement ink jet cartridges at the same ink jet cartridge refurbishment facility where the used ink jet cartridges went through the refurbishment process. Additionally, the replacement ink jet cartridges returned to the ink jet device users may be the same ink jet cartridges deposited by the respective ink jet device users or they may be different ink jet cartridges. In a situation where an ink jet cartridge received from an ink jet device user cannot be refurbished, the ink jet cartridge refurbishment facility may sell a new or previously refurbished ink jet cartridge to the user. Implementing the methods according to the present invention avoids the time and expense involved with sending the used ink jet cartridges to a central refurbishment facility. In addition, ink jet device users are able to save money by maximizing the life of an ink jet cartridge and avoid the costs associated with buying a new cartridge each time the ink runs out.

Used ink jet cartridges may be refurbished with an apparatus that includes ink recovery stations, an ink clean/fill station, and fill guns. The ink recovery stations remove any excess ink from the used ink jet cartridges and the fill guns supply ink to the empty used ink jet cartridges. The ink clean/fill station may be used to both drain excess ink and then re-fill a used ink jet cartridge. An apparatus according to the present invention may also include a pressure equalization station that equalizes the pressure in a used ink jet cartridge that has been re-filled. The variety of stations included with the apparatus according to the invention together with the various fill arrangements included in the system allows the apparatus to refurbish almost any type of ink jet cartridge.

The ink recovery stations, the ink clean/fill station, and the pressure equalization station operate using a vacuum source to perform their respective functions. A pressurized air distribution network and series of vacuum ejectors supply the vacuum necessary for these respective stations to work properly. The pressurized air distribution network includes several control valves that receive pressurized air from a common source. The air that enters the control valves exits through outlet tubes that are each connected to a vacuum ejector. Each vacuum ejector is connected to a vacuum fitting that corresponds to one of the ink recovery stations, the ink clean/fill station, or the pressure equalization station. The vacuum applied at the respective station either removes ink from a used ink jet cartridge, equalizes the pressure in a re-filled ink jet cartridge, or draws ink into an empty used ink jet cartridge.

The pressurized air distribution network may receive air from an external source or from an onboard compressor that is mounted within the housing of the apparatus of the present invention. The external source or the onboard compressor may be connected to a switching device that includes a first connector that is associated with the onboard compressor adjacent to a second connector that is associated with the external source. The switching device is connected to a pressure regulator that distributes regulated air to the pressurized air distribution network from either the external source or the onboard compressor.

Another aspect of the apparatus according to the invention is a fill gun control unit. The fill gun control unit includes ink pumps that are each used to supply ink to a respective fill gun. The ink pumps are driven by their own motor through a controller unit. When a particular fill gun is activated using the associated start switch, ink flows from the corresponding ink pump through an ink supply line to the fill gun for an amount of time set on the timer associated with the particular fill gun or until the operator activates the kill switch located on the fill gun to stop the flow of ink.

These and other advantages and features of the invention will be apparent from the following description of the preferred embodiments, considered along with the accompanying drawings.

DESCRIPTION OF PREFERRED EMBODIMENTS

Figure 2:
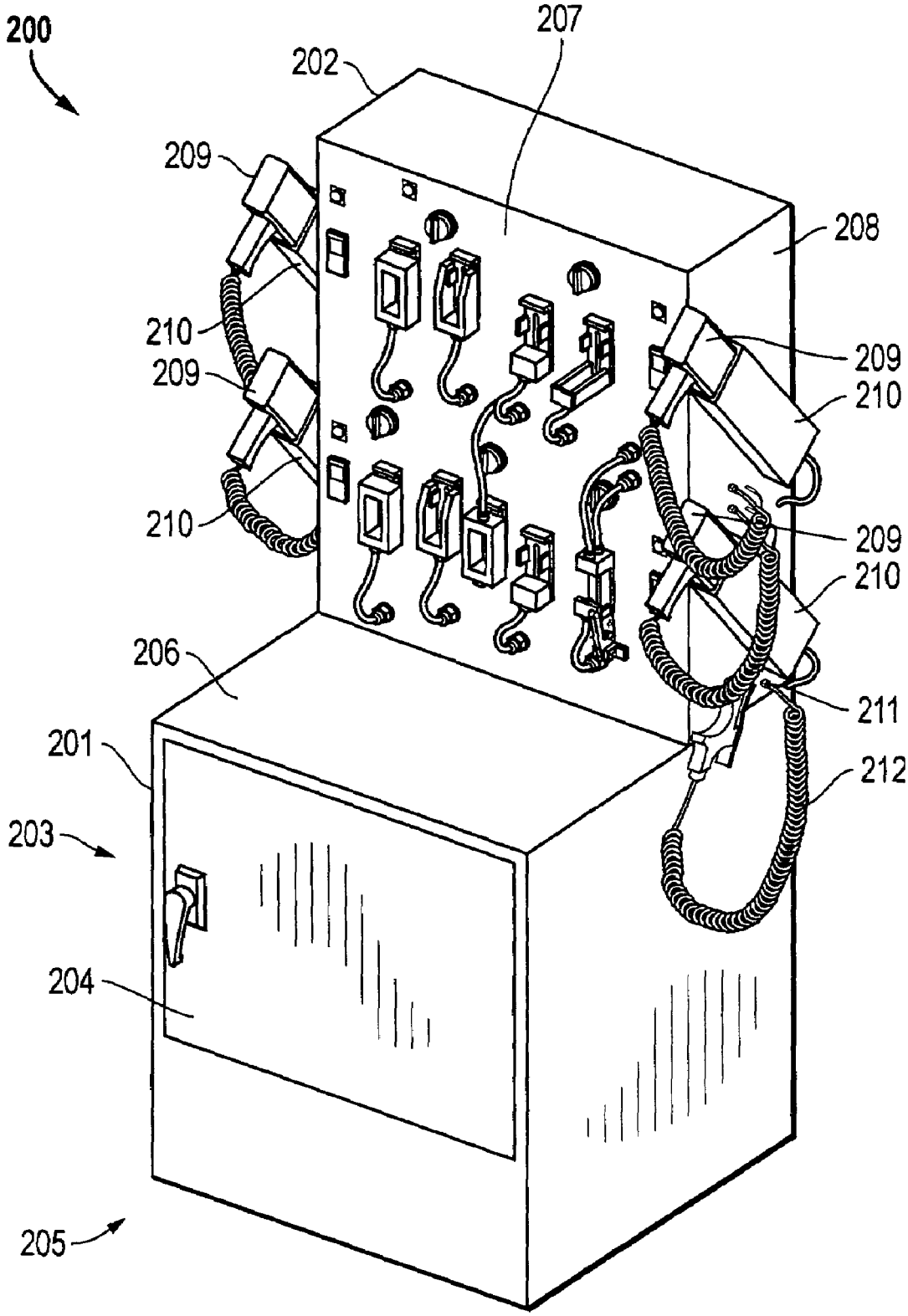
FIG. 2 is a front perspective view of an ink jet cartridge refurbishing system embodying the principles of the present invention.
Figure 3:
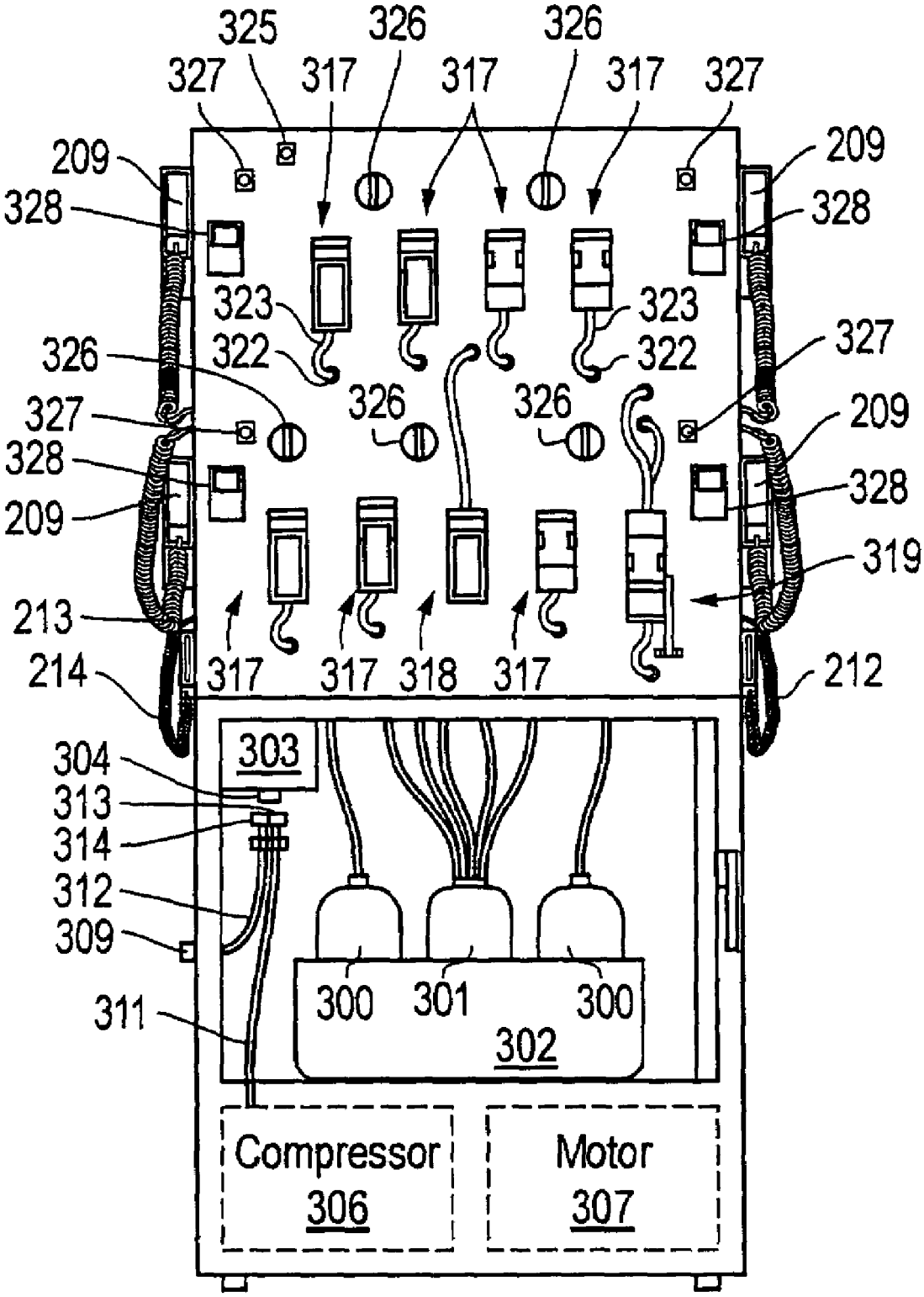
FIG. 3 is a front view of the ink jet cartridge refurbishing system shown in FIG. 2 with the cabinet door removed.
Figure 4:
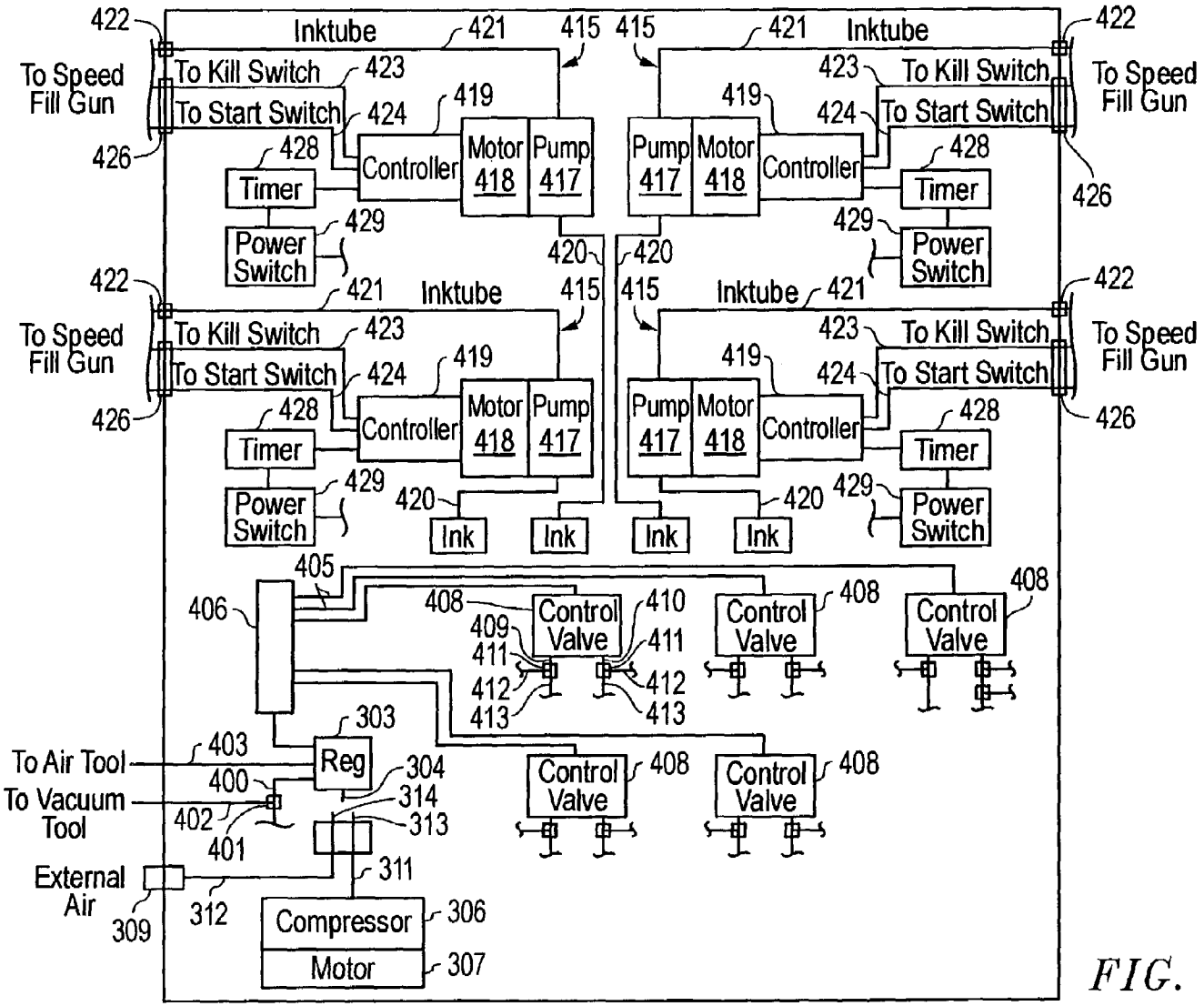
FIG. 4 is a diagrammatic representation of the ink jet cartridge refurbishing system shown in FIG. 2.

FIGS. 2 through 4 illustrate an ink jet cartridge refurbishing system 200 embodying the principles of the invention, while FIGS. 5 through 14 illustrate various components of the system. Referring first to the overall system views in FIGS. 2 and 3, ink jet cartridge refurbishing system 200 embodying the principles of the invention includes a lower cabinet generally shown at reference numeral 201 and an upper cabinet generally shown at reference numeral 202. Suitable casters preferably support lower cabinet 201 so that the system may be moved easily from location to location and then preferably locked in place. Lower cabinet 201 includes a first compartment 203 accessible through a cabinet door 204 shown in FIG. 2. Lower cabinet 201 also includes a second compartment 205 located below the first compartment. The top of lower cabinet 201 defines a work shelf 206. Upper cabinet 202 includes a front panel 207. Lateral sides 208 of upper cabinet 202 provide support surfaces for four separate ink jet cartridge filling guns 209, each with a separate receptacle or holster 210. One lateral side 208 also provides a location for a pressurized air fitting 211 adapted to provide air to utility air tool 212. The opposite lateral side 208 of upper cabinet 201 provides a location for a vacuum line fitting 213 adapted to connect with a vacuum application tool 214 (shown in FIG. 3).

As shown best in FIG. 3, the first compartment 203 of lower cabinet 201 provides a storage area for miscellaneous parts, equipment, and accessories. First compartment 203 also provides a location for storing ink reservoirs 300 for the various ink jet cartridge filling devices included in system 200 and one or more waste ink or recovered ink reservoirs 301 for receiving ink recovered from used ink jet cartridges in the course of refurbishment. All of these reservoirs are preferably contained in a tub 302 that provides secondary containment in the event of spills or overflows from the reservoirs. First compartment 203 also houses a pressure regulator 303 for regulating air pressure to the various components of the system 200 that require air pressure for operation. A quick connect fitting 304 is preferably associated with the inlet to pressure regulator 303.

Second compartment 205 is shown in the illustrated form of the system located below the first compartment 203. This compartment provides the preferred location for housing an onboard compressor 306 and motor 307 for driving the air compressor, although other forms of the invention may include the onboard compressor and compressor motor elsewhere in the system. The figures omit the motor controller and electrical connections associated with the motor so as not to obscure the invention in unnecessary detail, however, such controls and electrical lines will be included with the motor 307. This onboard compressor 306 provides sufficient air volume at the desired pressure to operate any of the various air pressure operated components of system 200. This onboard air capability is what allows system 200 to be placed in retail establishments as will be described below.

As indicated in FIG. 3, the preferred system 200 also provides a fitting 309 for accepting air pressure from an external source. This external source may be a large volume source that is capable of providing sufficient volume at the desired pressure to simultaneously operate substantially all of the air pressure driven components in system 200. In the preferred form of the invention, onboard compressor 306 supplies air through a hose 311 which is connected at its end to run parallel to a hose 312 that carries air from the external fitting. Each of these two hoses includes a respective quick connect connector 313 and 314 that is adapted to connect with quick connect fitting 304 associated with pressure regulator 303. An operator may switch back and forth between the onboard compressor 306 and external pressure source by connecting the appropriate hose 311 or 312 to the regulator fitting 304. Alternatively, conduits from both the onboard compressor 306 and external air fitting 309 may be routed to a suitable switching device (not shown) for switching between the two sources for application through pressure regulator 303.

Work shelf 206 defined by the upper surface of lower cabinet 201 provides a convenient location for holding various accessories and equipment that may be used by the system operator in performing the various refurbishing functions that may be performed with system 200. Front panel 207 of the upper cabinet 202 includes a number of different stations for performing refurbishing operations on ink jet cartridges. The illustrated form of the invention includes seven ink recovery stations each shown generally at reference numeral 317, one pressure equalization station 318, and one ink clean/fill station 319. Each of these stations operate using at least one vacuum connection. The required vacuum is supplied from a respective vacuum fitting 322 on front panel 207 through a respective vacuum hose 323. As will be discussed below with reference to FIG. 6, the ink clean/fill station 319 uses two separate vacuum connections and an ink supply connection. The required vacuum is created in each instance with a venturi effect device as will be discussed further below with reference to FIG. 4.

The various stations included in system 200 allow the system to refurbish substantially any type of ink jet cartridge. The specific refurbishment process varies from one cartridge to another, however, the various stations accommodate each process step. In some cartridges, it is necessary or desirable to completely remove any ink remaining in the cartridge or the remnants of any cleaning material that may have been injected in the cartridge. Ink or other liquid remnant removal may be accomplished in many cartridges using one of the recovery stations adapted for the particular cartridge. The cartridge is inserted into a cradle associated with the ink recovery station 317 in an operating position and then the vacuum is applied to withdraw the desired fluid from the cartridge. Other types of cartridges require a vacuum to be applied at a particular top opening in order to equalize the pressure in the cartridge and allow it to function properly. This pressure equalization is accomplished using pressure equalization station 318. Still other types of cartridges may be cleaned and filled in a single step in system 200 using ink clean/fill station 319 as will be described below.

Front panel 207 includes a number of switch actuators for controlling a switch mounted in the upper cabinet 202 behind the panel. A master switch actuator 325 controls the position of a compressor master switch and a number of vacuum control actuators 326 control the position of vacuum control switches. These switches will all be illustrated and described in connection with FIG. 4. Also visible in FIG. 3 are four fill gun switch actuators 327 and four timers 328 for controlling operation of the respective fill guns 209. The lateral sides 208 of upper cabinet 202 also provide a convenient location for fittings for a positive air pressure hose and utility air tool 212 a vacuum hose and vacuum application tool 214.

In order to allow system 200 to refurbish substantially any type of ink jet cartridge, the system includes a second type of ink jet cartridge filling arrangement in addition to the clean/fill station 319 mounted on front panel 207. This second type of ink jet cartridge filling arrangement includes the four separate fill guns 209 mounted on the lateral sides 208 of upper cabinet 202. The four separate guns 209 are required for the four different colors of ink used in current ink jet cartridges. One fill gun is connected to a supply of black ink, a second fill gun is connected to a supply of blue ink, the third fill gun is connected to a supply of red ink, and a fourth fill gun is connected to a supply of yellow ink. It should be noted that the ink supplies for each of the fill guns are preferably located in the first compartment 203 of lower cabinet 201 as shown in FIG. 3. Each of the fill guns 209 is adapted to be stored in a respective one of the holsters 210 (shown in FIG. 2) mounted on the lateral side 208 of upper cabinet 202. Each holster preferably is tilted downwardly and includes an overflow conduit (shown in FIG. 2) connected at its lowermost end to collect any overflow ink and direct it to one of the recovery ink reservoirs. As will be described in detail below with reference to FIGS. 4 and 14, each of the fill guns 209 is adapted to measure a desired amount of ink into an ink jet cartridge to refill the empty ink jet cartridge.

FIG. 4 provides a diagrammatic representation of the various internal components of ink jet cartridge refurbishing system 200 including the internal components associated with each fill gun 209 and the internal components associated with the various stations 317, 318, and 319 mounted on front panel 207. All of the vacuum operated portion of system 200 may be described with reference to the bottom portion of FIG. 4. The fill gun related components are shown in the upper portion of the figure.

Referring first to the pressurized air distribution network of system 200 in the lower half of FIG. 4, onboard air compressor 306 driven by compressor motor 307 provides pressurized air to produce the required vacuum by venturi effect. Air from compressor 306 is supplied through conduit or hose 311. Air that may be supplied from an external source through external source fitting 309 is directed through conduit or hose 312. Both hoses preferably terminate in a respective quick connect fitting 313 and 314, both of which are adapted to connect to a fitting 304 associated with pressure regulator 303. Connector 313 associated with hose 311 is connected to regulator fitting 304 when onboard compressor 306 supplies air for system 200. Alternatively, connector 314 associated with hose 312 is connected to regulator fitting 304 when air is to be supplied from the external source.

Pressure regulator 303 regulates the supplied air to the desired constant pressure for operating the various vacuum generating venturi devices described below. Various conduits distribute the regulated pressurized air to the venturi devices, known as vacuum ejectors, and controls associated with those devices. One conduit 400 runs to a vacuum tool ejector 401. The vacuum tube 402 extending from vacuum tool ejector 401 provides a vacuum for the vacuum application tool. Another conduit 403 provides air pressure for the utility air tool. A separate distribution conduit 405 is provided for each station in system 200 requiring a vacuum source. Distribution conduits 405 are shown in FIG. 4 as extending from a common manifold 406, although any suitable distribution arrangement may be employed. The distal end of each station distribution conduit 405 is connected to a respective control valve 408. These valves are operated by the vacuum control actuators 326 mounted on front panel 207 as shown especially in FIG. 3. Each control valve 408 is adapted to alternatively block the flow of air to its respective two outlet tubes 409 and 410 or to direct air to either one of the associated outlets. No control valve is shown as being associated with the conduit 400 for supplying air to operate the vacuum application tool, however, other forms of the invention may include a suitable valve for enabling or disabling the vacuum application tool.

Each outlet tube 409 and 410 is associated with a respective vacuum ejector 411. Each vacuum ejector creates a vacuum at vacuum tube 412 as the pressurized air flows straight through the ejector from the respective outlet tube to a respective exhaust tube 413. Thus, when a particular control valve 408 is switched to allow air to flow through a particular outlet tube 409 or 410, the air passing through the main path of the respective vacuum ejector 411 creates the desired vacuum in tube 412. Each vacuum tube 412 extends to a respective one of the vacuum fittings 322 mounted on front panel 207 (shown in FIG. 3). Each exhaust tube 413 extends to one of the recovered ink reservoirs included in the system as shown in FIG. 3. It will be noted that the illustrated system 200 includes a total of nine stations and thus one of the control valves includes only a single outlet tube 409.

Referring now to the upper portion of FIG. 4, four separate control units 415 are provided for the four separate fill guns 209 shown in FIG. 3. Each control unit 415 includes a separate ink pump 417 driven by a respective motor 418 through a respective motor controller 419. Each pump 417 preferably includes a peristaltic pump, receives ink from a respective ink supply 420, and directs ink through ink tube 421 that terminates in a suitable fitting 422 on an external surface of system 200. In the illustrated form of the invention the ink outlet fittings 422 are mounted on the lateral sides 208 of upper cabinet 202 as indicated in FIG. 2. Each controller 419 for the respective pump motor 418 includes a number of electrical control lines that extend to switches mounted on the respective fill gun as will be described further below with reference to FIG. 14. FIG. 4 shows a separate control line 423 for a kill switch and a separate control line 424 for a fill gun start switch. In the preferred form of the invention, the electrical control lines extend from the controller 419 to a suitable fitting 426 on an external surface of upper cabinet 202. A suitable connecting line connects to these fittings 426 and extends to the respective fill gun as will be described below with reference to FIG. 14. FIG. 4 also shows that each controller 419 is associated with a respective timer 428 and a respective power switch 429 connected to a suitable electrical power supply (not shown in FIG. 4) for driving the respective pump motor 418. As will be described further below, each timer 428 is used to control the respective pump 417 to supply a desired volume of ink to fill an ink jet cartridge being refurbished.

Figure 5:
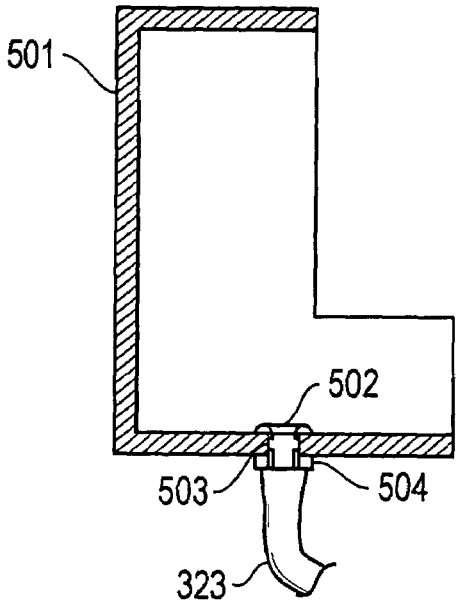
FIG. 5 is a view in longitudinal section of a recovery cradle used in the system shown in FIG. 2.

FIG. 5 shows an ink recovery station 317 included on the front panel 207 of refurbishing system 200. Ink recovery station 317 includes a fitting or receiver referred to as a cradle 501 that is adapted to receive a particular type or style of ink jet cartridge. Cradle 501 snugly receives the particular type of ink jet cartridge (not shown in FIG. 5) with a desired component on the cartridge, normally the print head, aligning with a vacuum sealing element 502 on an inner surface of the cradle 501. The vacuum sealing element 502 is associated with an opening 503 in the cradle and a fitting 504 to which a connecting vacuum hose 323 (also shown in FIG. 3) may be connected. It will be appreciated that each cradle is specifically adapted for a particular type of ink jet cartridge. It should also be noted that when vacuum sealing element 502 is adapted to seal against a printhead, the vacuum sealing element preferably overlaps with a peripheral portion of the plate commonly associated with a printhead so that the vacuum is not allowed to pull the printhead plate from its position on the ink jet cartridge.

In order to accommodate the relatively wide variety of different types of ink jet cartridges, the illustrated system 200 includes the seven different ink recovery stations. System 200 includes one pressure equalization station (318 in FIG. 3) which is similar to the ink recovery station 317 except that the vacuum is applied to a top part of the cartridge. This application of a vacuum to a top opening of a particular type of cartridge using an equalization vacuum sealing element with the cartridge in a pressure equalizing position is required to equalize pressure in the cartridge after it has been refilled.

Figure 1:
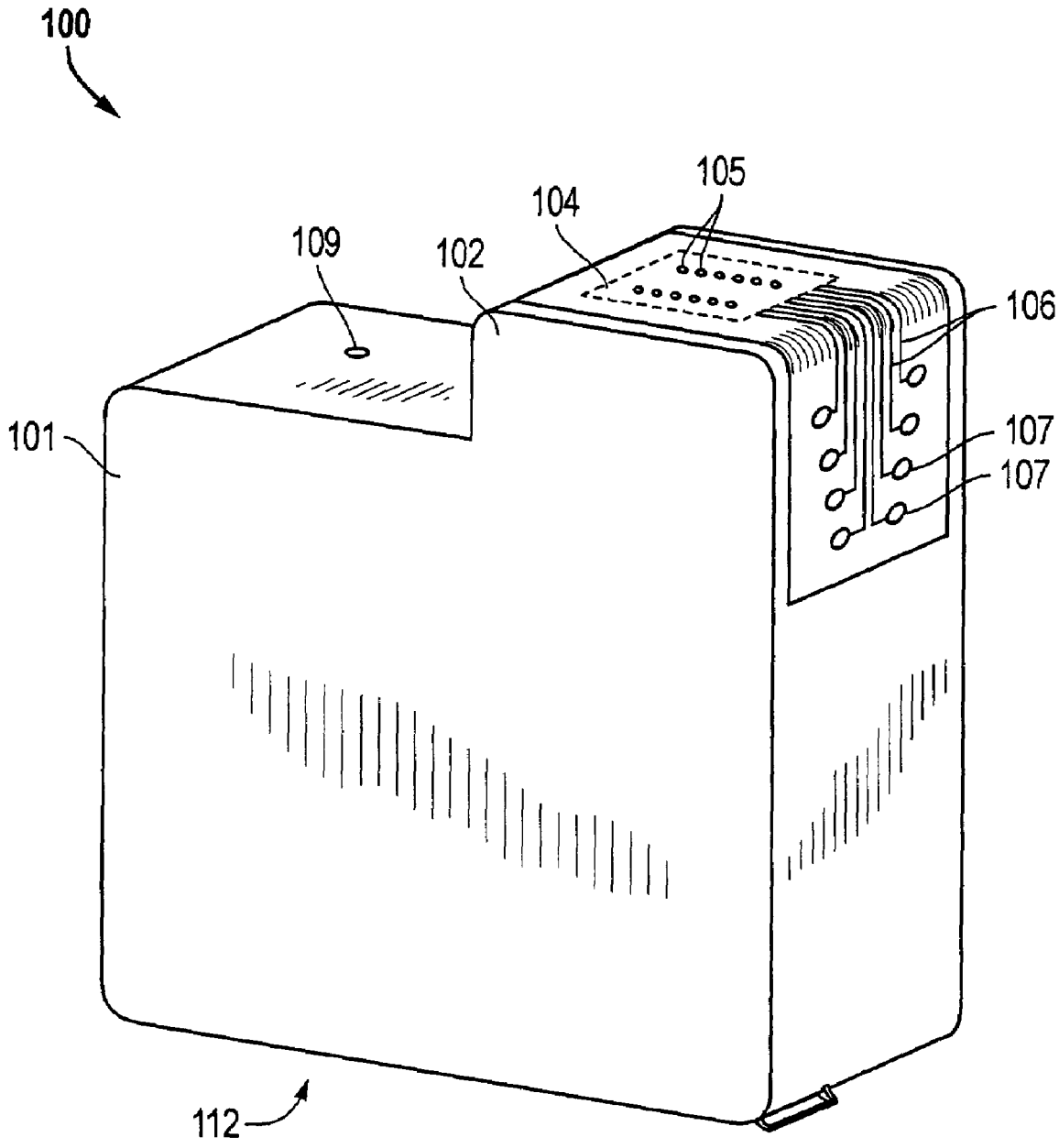
FIG. 1 (Prior Art)
FIG. 1 is a view in perspective of a prior art ink jet cartridge of a type that may be refurbished according to the present invention.
Figure 6:
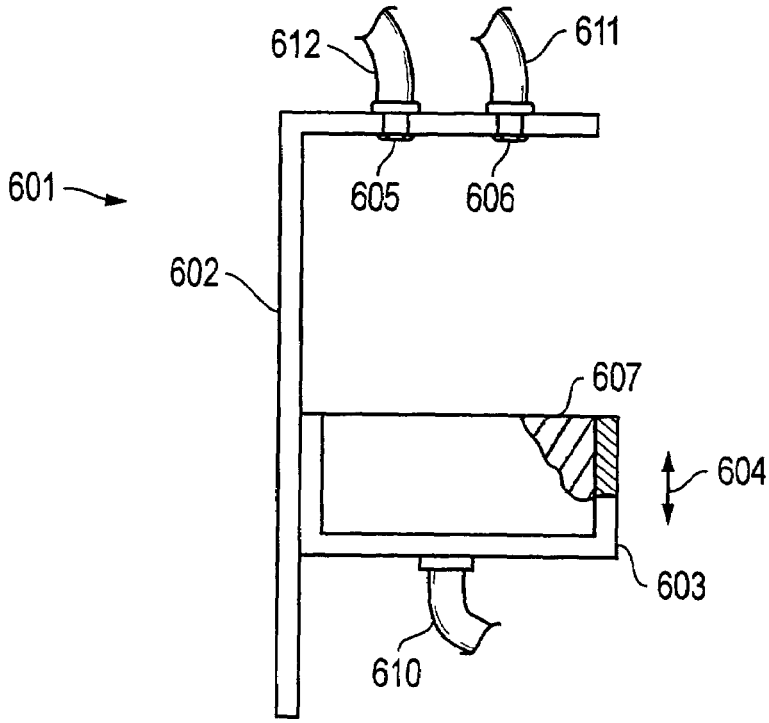
FIG. 6 is a partially cut away side view of a cleaning and filling cradle used in the refurbishing system shown in FIG. 2.

FIG. 6 shows the cradle 601 associated with the ink clean/fill station 319 shown in FIG. 3. This particular station is adapted to clean and fill a popular type of ink jet cartridge using a particular cleaning and filling technique. Clean/fill cradle 601 includes a stationary component 602 and a sliding component 603. Sliding component 603 is adapted to slide up and down with respect to stationary component 602 as indicated by arrow 604. In an upper position, the sliding component 603 presses an ink jet cartridge received in the cradle against an upper part of the stationary component 602 to provide seals against two upper sealing elements 605 and 606. A seal is also produced in a resilient material 607 lining the upper surface of sliding component 603. A vacuum is required at two different points in cradle 601. Thus, it will be noticed in FIG. 4 that one of the control valves 408 directs air through two separate vacuum ejectors 411. The vacuum from one ejector is applied through tube 610 to the sliding component of cradle 601. The vacuum from the other ejector is applied to the stationary component 602 of cradle 601 through tube 611. Cradle 601 is also connected to an ink fill tube 612 which ultimately extends to an ink supply reservoir preferably mounted in lower cabinet 201. In the particular type of ink jet cartridge with which clean/fill cradle 601 is adapted to be used, the used cartridge is placed in the cradle in a clean/fill position so that the ink fill tube 612 and associated ink fill sealing element 605 aligns with a vent opening (109 in FIG. 1), the upper vacuum supply tube 611 and associated print head sealing element 606 aligns with the printhead (104 in FIG. 1) of the cartridge, and the lower vacuum supply line 610 applies a vacuum to the maze opening (110 in FIG. 1) of the cartridge through a maze vacuum sealing element. The vacuum applied to the maze opening ensures that the valve associated with the maze opening stays closed while the vacuum applied through the printhead draws ink into the reservoir through the ink fill tube 612 and cartridge vent opening. It will be noted that the resilient material 607 on slide component 603 is permeable so that the vacuum may be applied to the cartridge maze opening.

Figure 7:
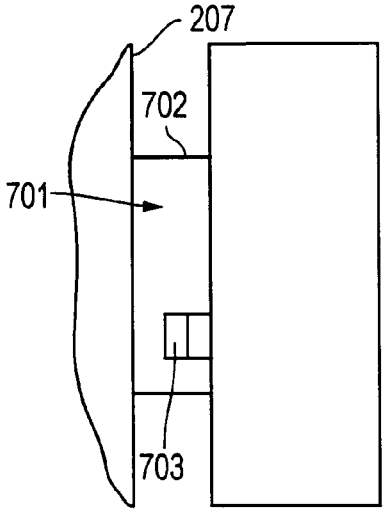
FIG. 7 is a side view showing a preferred cradle attachment arrangement that may be used for one or more cradles in the refurbishing system shown in FIG. 2.

Referring now to FIG. 7, the cradle associated with at least each ink recovery station and the pressure equalization station (317 and 318, respectively in FIG. 3) on system 200 is preferably attached to front panel 207 with a cradle attachment 701 that allows the respective cradle to be removed and replaced with a different cradle as necessary to accommodate different types of ink jet cartridges. The preferred cradle attachment 701 includes a first component 702 which is adapted to be attached to front panel 207 at a suitable location for the station near the vacuum fitting 322 (shown in FIG. 3) associated with the respective station. This first component 702 is shown particularly in FIGS. 8 through 10. A second component 703 of cradle attachment 701 is adapted to be connected to a back surface of the respective cradle and cooperates with first component 702 to produce a secure but easily releasable attachment between the cradle and front panel 207. This second component 703 is illustrated particularly in FIGS. 11 and 12.

Figure 9:
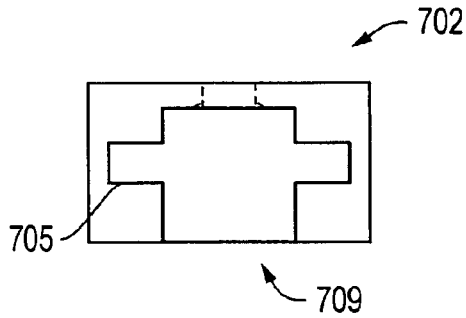
FIG. 9 is a top view of the first cradle attachment component.
Figure 8:
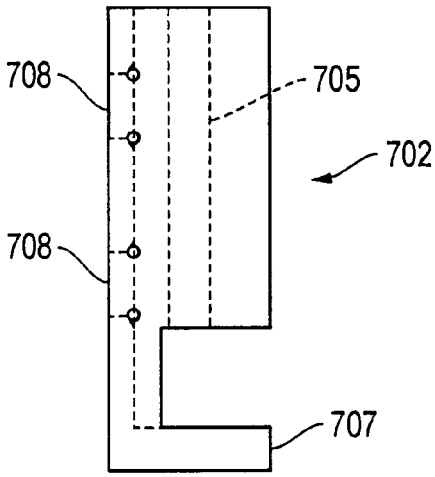
FIG. 8 is a side view of a first cradle attachment component.
Figure 10:
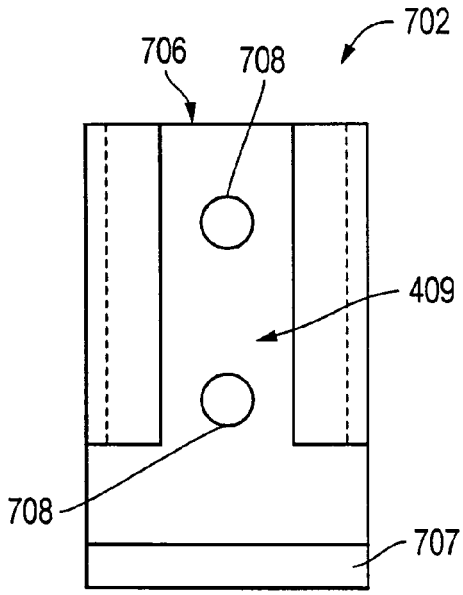
FIG. 10 is a front view of the first cradle attachment component.

As shown in FIGS. 8 through 10, first component 702 of cradle attachment arrangement 701 includes a block of material having a receiving slot 705 (shown in FIG. 9) formed therein. Receiving slot 705 includes a top opening 706 and terminates at the opposite end of first component 702 with a support member 707. It will be noted particularly from the top view of FIG. 9 that receiving slot 705 includes generally a T-shaped cross-section. FIG. 10 shows that the base of the T-shape comprises a front opening 709. Although any suitable connector may be used, in the preferred form of the invention first component 702 is connected to front panel 207 with bolts and thus includes bolt holes 708 through which the connecting bolts may extend.

Figure 11:
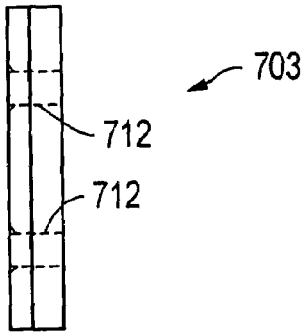
FIG. 11 is a side view of a second cradle attachment component.
Figure 12:
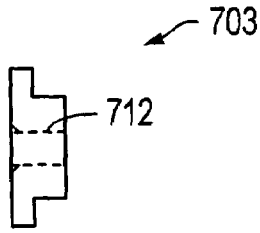
FIG. 12 is a top view of the second cradle attachment component.

Referring now to FIGS. 11 and 12, second component 703 of cradle attachment arrangement 701 includes an elongated member having a generally T-shaped transverse shape as shown best in FIG. 12. This T-shape corresponds generally to the transverse shape of receiving slot 705. Second component 703 is adapted to be bolted to a cradle and thus also includes bolt holes 712, although the invention is not limited by the manner in which second component 703 is connected to the cradle. In fact, the cradle and second attachment component may be integrally formed.

Figure 13:
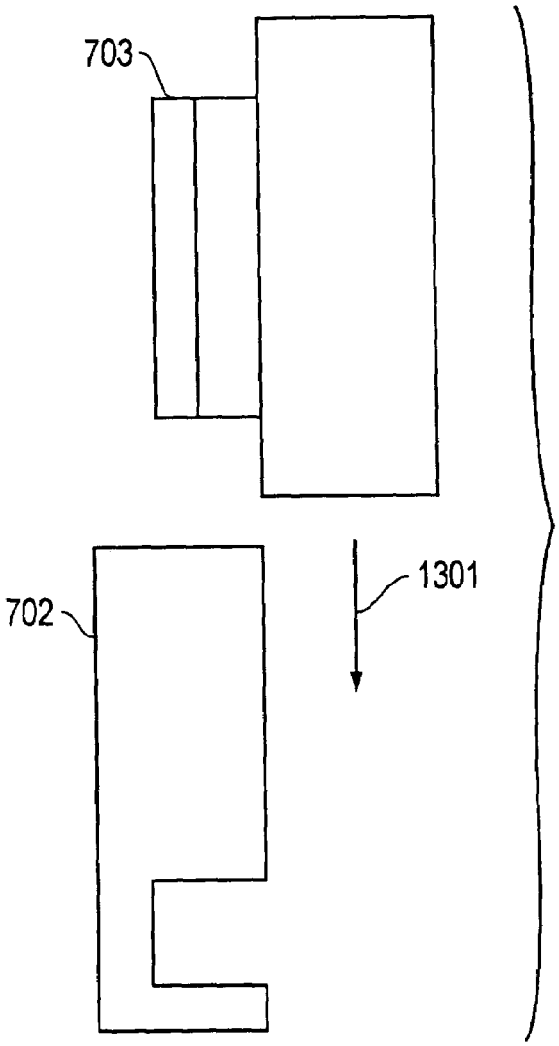
FIG. 13 is an exploded side view of the cradle and cradle attachment arrangement shown in FIG. 7.

FIG. 13 shows first component 702 secured in an appropriate position on front panel 207 and second component 703 secured to the back surface of a cradle. The cradle may be secured to panel 207 by first positioning the cradle and attached second component 703 above the first component 702 as shown in FIG. 13. From this point, the cradle and second component 703 may be moved along a line indicated by arrow 1301. Eventually the T-shaped second component 703 slides into the correspondingly shaped slot 705 (shown in FIG. 9) until the components reach the position shown in FIG. 7. In this position, the cradle is securely attached to front panel 207 and may receive an ink jet cartridge for a desired refurbishment operation. However, the cradle may be removed easily by simply sliding it upwardly in a direction opposite to that indicated by arrow 1301 until the T-shaped second component 703 clears slot 705. Another different cradle with the same type of second component connected thereto may then be slid into the first component 702 to accept a different type of ink jet cartridge as necessary.

Figure 14:
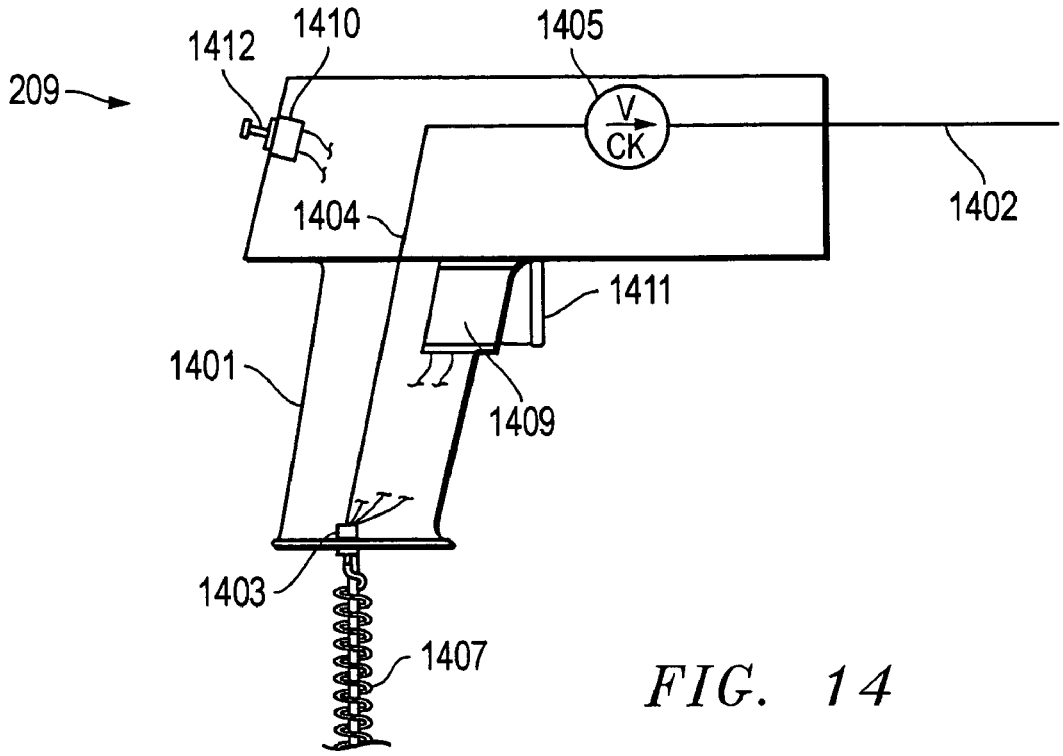
FIG. 14 is a mostly diagrammatic representation of one of the ink jet cartridge filling guns included in the ink jet cartridge refurbishing system shown in FIG. 2.

FIG. 14 shows a somewhat diagrammatic representation of one of the fill guns 209 described above especially in FIGS. 2 and 3. The fill gun 209 includes a handle or pistol-type grip 1401 and a fill needle 1402. The gun also includes a fitting 1403 for making a connection with an ink supply line/electrical control line 1407. An ink conduit 1404 extends from fitting 1403 to a proximal end of fill needle 1402. Preferably a suitable check valve 1405 is included in this conduit 1404 to prevent ink from flowing back in the direction from the fill gun to the ink supply line/control line 1407. Fill gun 209 also includes two switches, a start switch 1409 and a kill switch 1410. Start switch 1409 is activated through a trigger actuator 1411, while kill switch 1410 is activated through a separate button actuator 1412.

The operation of fill gun 209 may now be described with reference to FIGS. 14 and 4. In order to fill an empty ink jet cartridge with fill gun 209, the operator first withdraws the fill gun 209 from its respective holster 210 on system 200 and inserts the distal end of the needle 1402 into an orifice on the particular ink jet cartridge. The operator also sets the timer 428 associated with fill gun 209 to run the associated pump for a particular time. Since pump 417 runs at a known speed and moves a known volume of ink in any given time, setting timer 428 has the effect of setting the volume of ink to be supplied to the cartridge. Once timer 428 is set and the needle is appropriately placed in the empty ink jet cartridge, the operator depresses the trigger actuator 1411 to trip the start switch 1409. The controller 419 associated with the pump 417 uses the signal generated at the start switch to start motor 418 and cause pump 417 to start dispensing ink through needle 1402. The motor 418 continues to run until the timer 428 runs down to zero at which point the timer signals motor controller 419 to stop the motor and thus the flow of ink into the cartridge. At any point in the process the operator may depress the kill switch actuator 1412 to provide a signal to the motor controller to stop the motor before receiving a signal from the timer. The user may wish to do this for example when the needle proves to be incorrectly placed in the ink jet cartridge and ink does not flow into the cartridge as desired.

Although the illustrated form of the invention includes timers for measuring the volume of ink supplied to fill the ink jet cartridge, other forms of the invention may use different arrangements for metering the volume of ink into a cartridge. For example, the volume of ink supplied to refill a cartridge may be measured directly from a suitable positive displacement pumping device.

The self-contained ink jet cartridge refurbishing system 200 described above has particular application in a retail ink jet cartridge refurbishing facility. Because the system 200, with its various stations, various cradles, and multiple filling arrangements is specifically adapted to be able to refurbish substantially any ink jet cartridge, the system can be employed in a retail arrangement in which a user brings their used cartridge to the retail refurbishing center, drops the cartridge off for refurbishment, and then later picks up the refurbished cartridge after the cartridge has been refurbished at the retail location. This is in contrast to prior ink jet cartridge refurbishing systems in which the cartridge had to be sent away to a central refurbishing facility. In another variation of the refurbishment arrangement, the ink jet device user may trade in their used cartridge for a refurbished cartridge. An operator then uses the system 200 to refurbish the used cartridge and make it available to another customer dropping off a like cartridge.

In any refurbishment application, retail or production, certain additional equipment may be required to ensure the refurbished cartridge is in a usable state. For example, a testing unit such as Makro Micro Company, Croatia, Model CT8 or CT56 may be used to test each refurbished cartridge to ensure it is in proper working order prior to distribution to a customer or return to the user who dropped off the cartridge for refurbishment.

The above described preferred embodiments are intended to illustrate the principles of the invention, but not to limit the scope of the invention. Various other embodiments and modifications to these preferred embodiments may be made by those skilled in the art without departing from the scope of the following claims.

The invention claimed is:

1. An apparatus for refurbishing used ink jet cartridges, the apparatus including:

a housing;

a number of ink recovery stations supported by the housing, each ink recovery station including a vacuum sealing element that aligns with a printhead on any of a number of ink jet cartridges received in an operating position at the respective ink recovery station;

an ink clean/fill station supported by the housing that includes an ink fill sealing element that aligns with a vent opening on any of the number of ink jet cartridges received in a clean/fill position at the ink clean/fill station, a maze vacuum sealing element that aligns with a maze hole on any of the number of ink jet cartridges received in the clean/fill position, and a print head sealing element that aligns with the printhead on any of the number of ink jet cartridges received in the clean/fill position; and a number of fill guns supported by the housing, each fill gun including a fill needle, a handle connected to the fill needle, and a start switch provided on the handle, the fill needle being connected to receive fluid directly through a respective ink supply line and discharge the fluid through a fill opening associated with the fill needle.

2. The apparatus of claim 1 further including a pressure equalization station supported by the housing that includes an equalization vacuum sealing element that aligns with the printhead on any of the number of ink jet cartridges received in a pressure equalizing position at the pressure equalization station.

3. The apparatus of claim 2 further including a pressurized air distribution network, the pressurized air distribution network including:

a number of control valves, each control valve connected to a distal end of a respective distribution conduit where each distribution conduit is operatively connected to a pressurized air source;

each control valve having a respective outlet tube extending to a respective vacuum ejector;

each vacuum ejector having a respective vacuum tube extending to a respective vacuum fitting, the respective vacuum fitting being operatively connected to one of the ink recovery stations, the ink clean/fill station, or the pressure equalization station; and each vacuum ejector also having a respective exhaust tube extending to a recovered ink reservoir supported by the housing.

4. The apparatus of claim 3 wherein the pressurized air source is an onboard compressor, wherein the apparatus includes a housing and the pressurized air source is mounted within the housing.

5. The apparatus of claim 4 further including a switching device for receiving pressurized air from either an external source or the onboard compressor.

6. The apparatus of claim 5 wherein the switching device includes a first connector that may be operatively connected to the onboard compressor, the first connector being adjacent to a second connector that may be operatively connected to the external source.

7. The apparatus of claim 6 further including a pressure regulator connected between the switching device and the distribution conduits, the pressure regulator receiving pressurized air through the switching device and distributing regulated pressurized air to the control valves.

8. The apparatus of claim 7 wherein the pressure regulator is operatively connected to a vacuum tool ejector, the vacuum tool ejector being operatively connected to a vacuum application tool.

9. The apparatus of claim 7 wherein the pressure regulator is operatively connected to a utility air tool.

10. The apparatus of claim 1 further including a fill gun control unit, the fill gun control unit including:

a number of ink pumps, each ink pump driven by a respective motor through a respective motor controller;

a number of ink tubes, each ink tube extending from each respective ink pump to a respective ink supply line; and wherein each respective motor controller is operatively connected to:

a kill switch on each respective fill gun by a respective control line; and the start switch on each respective fill gun by a respective different control line.

11. The apparatus of claim 10 further including a number of fill gun switch actuators, each fill gun switch actuator operatively connected to the motor controller.

12. The apparatus of claim 10 further including a number of timers, each timer operatively connected to the motor controller.

* * * * *